US008231407B1

(12) United States Patent
Zhao et al.

(10) Patent No.: US 8,231,407 B1
(45) Date of Patent: Jul. 31, 2012

(54) CABLE ASSEMBLY WITH IMPROVED GROUNDING BAR

(75) Inventors: Jim Zhao, Irvine, CA (US); David Ko, Fullerton, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 7 days.

(21) Appl. No.: 13/006,415

(22) Filed: Jan. 13, 2011

(51) Int. Cl.
*H01R 9/05* (2006.01)

(52) U.S. Cl. ..... 439/579; 439/497

(58) Field of Classification Search ..... 439/497, 439/579

See application file for complete search history.

(56) References Cited

U.S. PATENT DOCUMENTS

| | | | | |
|---|---|---|---|---|
| 6,123,582 | A * | 9/2000 | Ko et al. | 439/579 |
| 6,655,992 | B1 * | 12/2003 | Ko | 439/579 |
| 6,676,444 | B2 * | 1/2004 | Noro | 439/579 |
| 6,755,687 | B1 | 6/2004 | Ko | |
| 6,863,559 | B2 * | 3/2005 | Yu | 439/497 |
| 8,109,788 | B1 * | 2/2012 | Harlan et al. | 439/579 |

* cited by examiner

*Primary Examiner* — James Harvey
(74) *Attorney, Agent, or Firm* — Wei Te Chung; Andrew C. Cheng; Ming Chieh Chang

(57) ABSTRACT

A cable assembly (1000) includes an elongated housing (10) having a base portion and a mating portion, said base portion having an upper surface; a plurality of contacts (20) received in the housing; a plurality of cables (30) each comprising an inner conductor (301) and an outer conductor (302) insulated from the inner conductor, said inner conductor connected to the corresponding contact; a grounding bar (40) mounted to the base portion and substantially flush with the upper surface, said grounding bar extending along a transversal direction, with a plurality of passages (43) defined thereon to accommodate the outer conductors, respectively.

20 Claims, 9 Drawing Sheets

CABLE ASSEMBLY WITH IMPROVED GROUNDING BAR

BACKGROUND OF THE INVENTION

1. Field of the Invention

The present invention relates generally to a cable assembly, and more particularly to a cable assembly used in electric device and having improved grounding bar.

2. Description of the Prior Art

Present cable assembly is needed to own low profile, small size and simple production. A micro coaxial cable assembly always comprises a housing, a plurality of contacts, a plurality of micro coaxial cables connected to the contacts and a grounding bar. U.S. Pat. No. 6,755,687, issued to Ko on Jun. 29, 2004, discloses a micro coaxial cable assembly. The cable assembly comprises a housing, a plurality of contacts, a plurality of micro coaxial cables, a pair of shells and a grounding bar. However, the grounding bar increases the height of the cable assembly and is not suit for low-profile cable assembly.

Hence, in this art, an improved cable assembly to overcome the above-mentioned disadvantages of the prior art should be provided.

BRIEF SUMMARY OF THE INVENTION

A primary object, therefore, of the present invention is to provide a cable assembly with an improved grounding bar.

In order to implement the above object, the cable assembly comprises an elongated housing having a base portion and a mating portion, said base portion having an upper surface; a plurality of contacts received in the housing; a plurality of cables each comprising an inner conductor and an outer conductor insulated from the inner conductor, said inner conductor connected to the corresponding contact; a grounding bar mounted to the base portion and substantially flush with the upper surface, said grounding bar extending along a transversal direction, with a plurality of passages defined thereon to accommodate the outer conductors, respectively.

Other objects, advantages and novel features of the invention will become more apparent from the following detailed description of a preferred embodiment when taken in conjunction with the accompanying drawings.

DETAILED DESCRIPTION OF THE INVENTION

Figure 1:
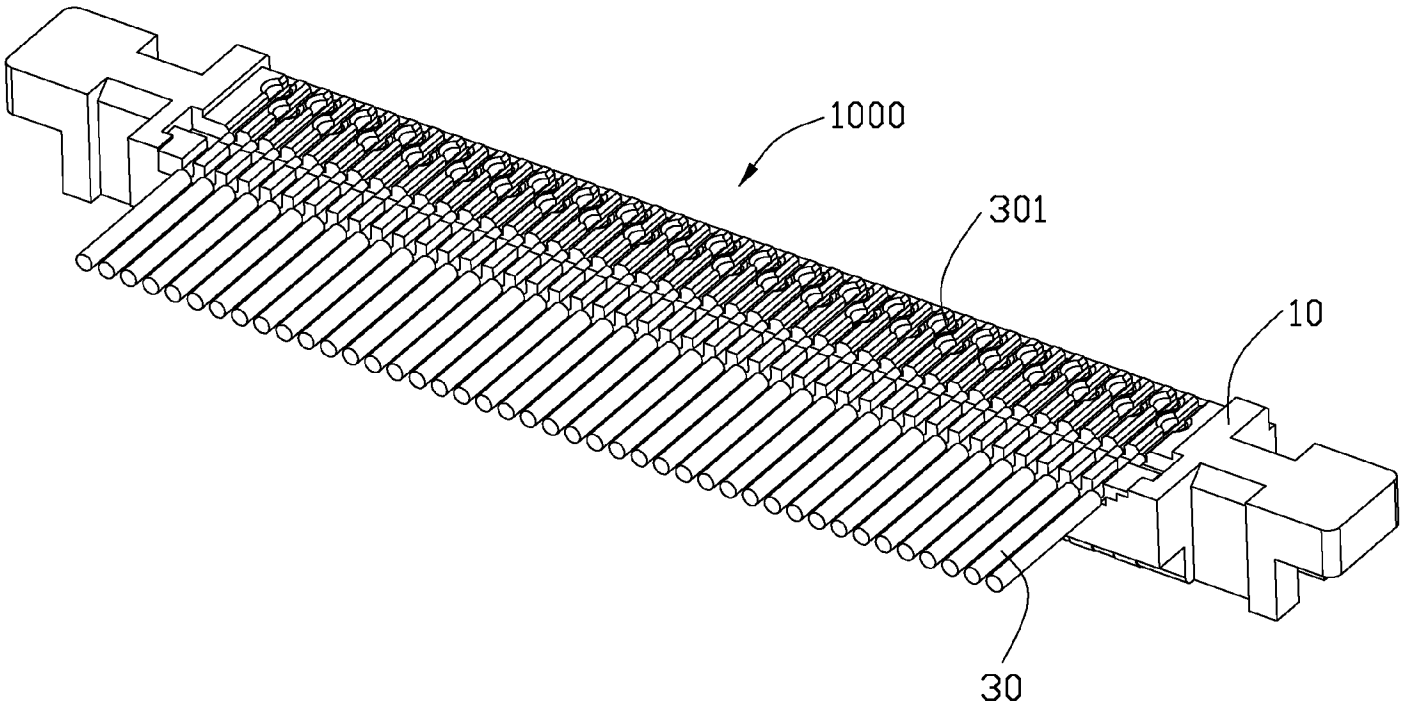
FIG. 1 is a perspective view of a cable assembly of a first embodiment in according with the present invention.
Figure 2:
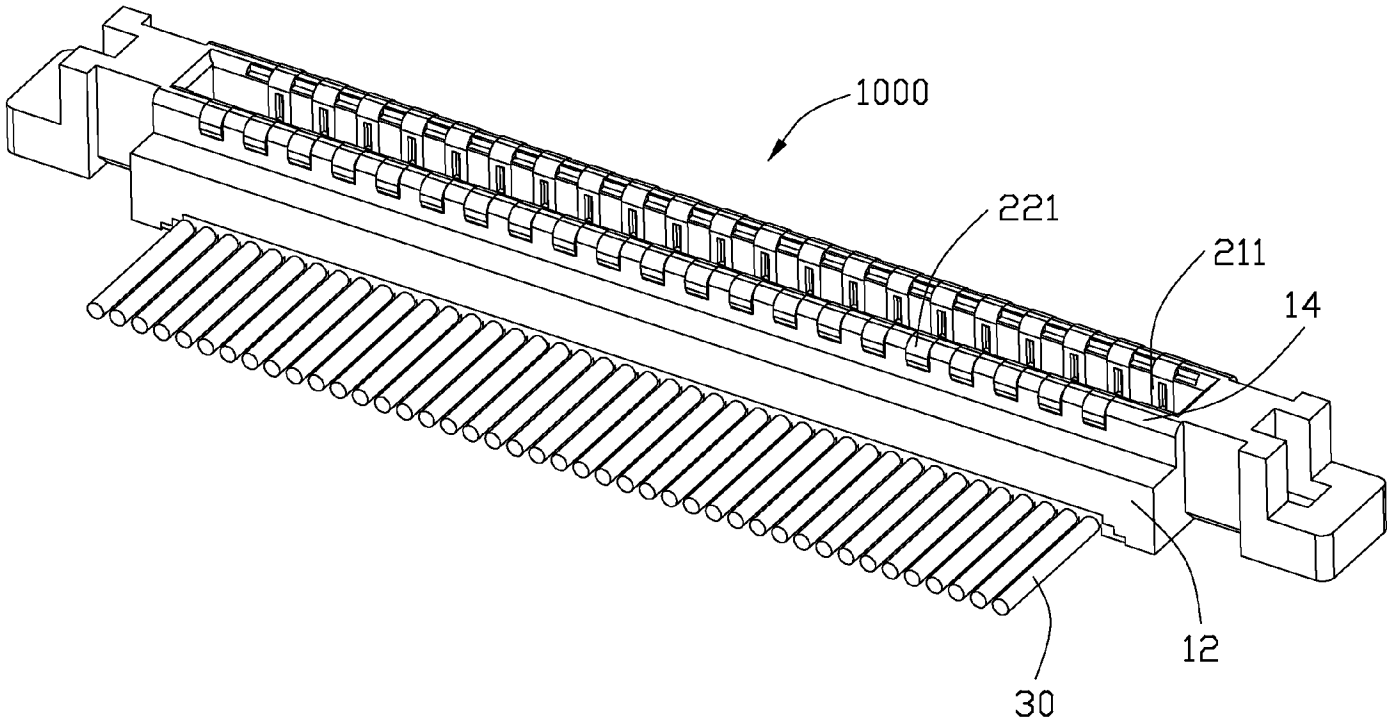
FIG. 2 is a view similar to FIG. 1, but taken from a different aspect.
Figure 3:
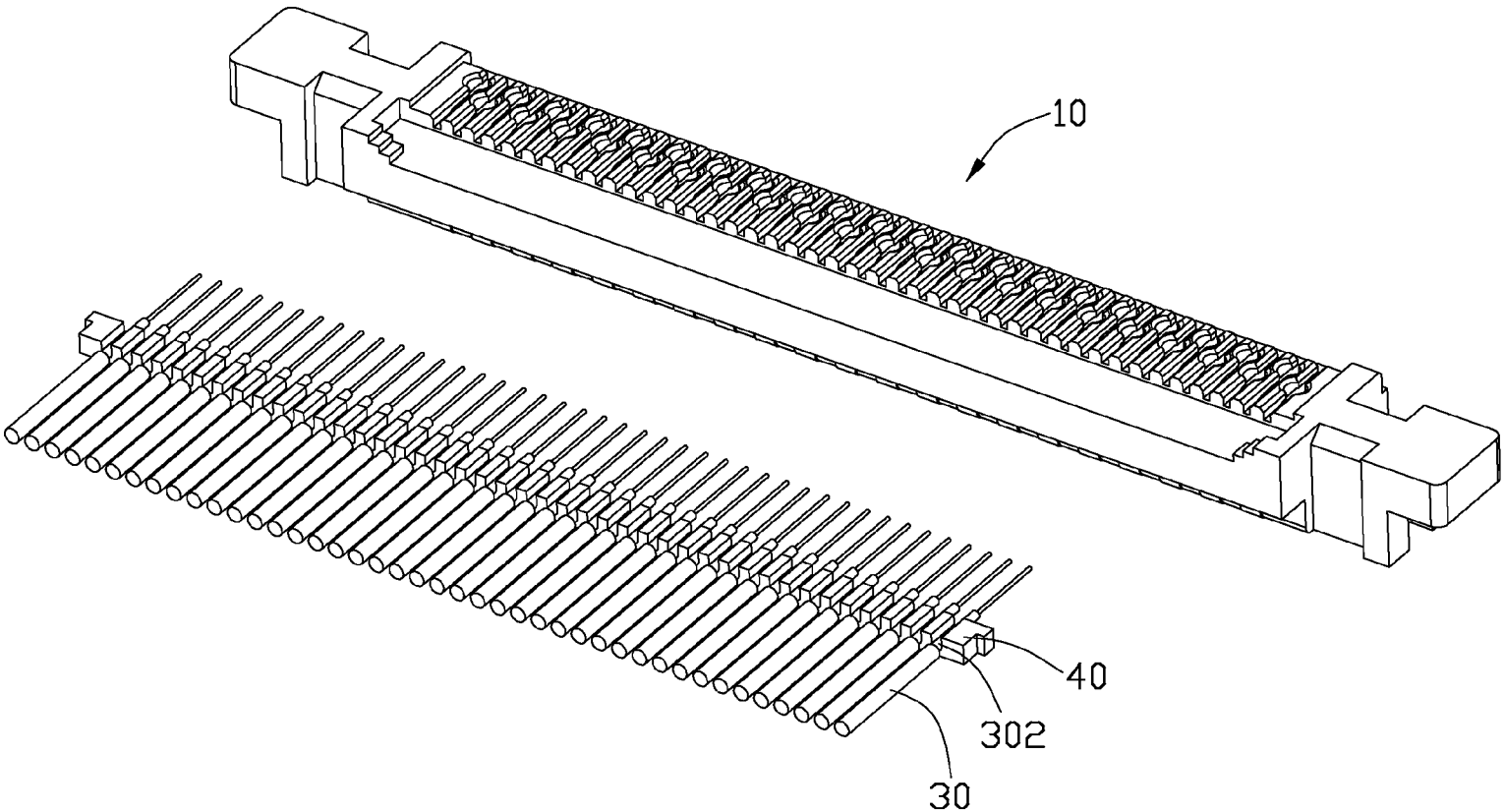
FIG. 3 is a partially exploded, perspective view of the cable assembly in FIG. 1.
Figure 4:
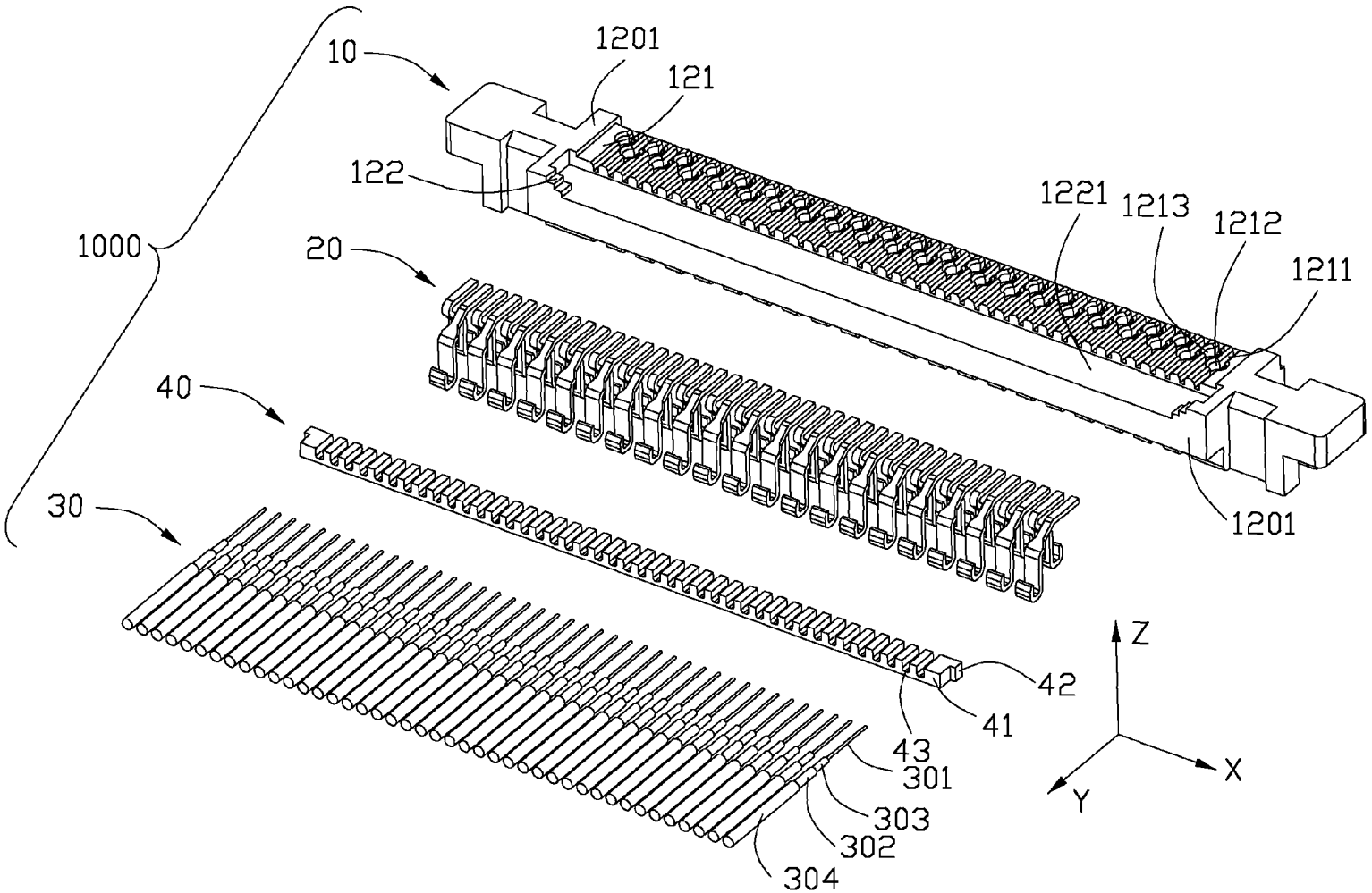
FIG. 4 is an exploded perspective view of the cable assembly in FIG. 1.
Figure 5:
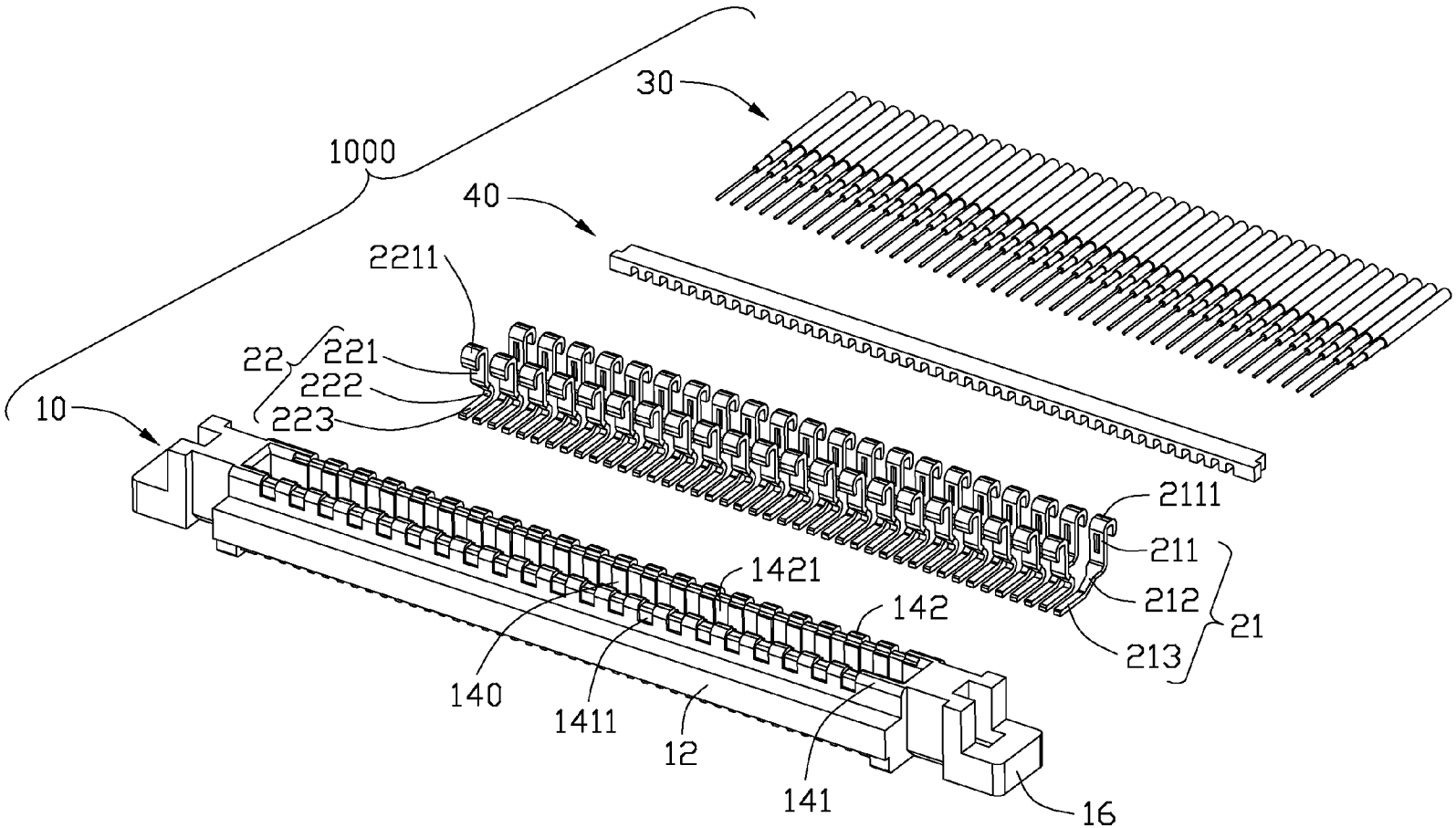
FIG. 5 is a view similar to FIG. 4, but viewed from other direction.

Reference will now be made in detail to a preferred embodiment of the present invention.

Referring to FIGS. 1 to 5, a cable assembly 1000 of a first embodiment in accordance with the present invention is illustrated. The cable assembly 1000 comprises an elongated housing 10, a plurality of contacts 20 received in the housing 10, a plurality of cables 30, a grounding bar 40 received in the housing 10.

The housing 10 is made of plastic or other insulative material and comprises base portion 12, a mating portion 14 extending downwardly from the base portion 12, and a pair of wing portions 16 disposed at lateral sides and further connected to the base portion 12 and the mating portion 14.

The base portion 12 has a top side which defines a first supporting area 121 and a second supporting area 122 disposed behind the first supporting area 121. There is plurality of grooves 1211 located in the first supporting area 121, and each of the grooves 1211 extends along a longitudinal direction (front-to-back direction). The grooves 1211 are arranged in a row along a transversal direction along. In addition, a first cavity 1212 and a second cavity 1213 are located in each two adjacent grooves 1211. The first cavities 1212 and the second cavities 1213 are disposed in staggered manner. Also, the first cavities 1212 are disposed behind the second cavities 1213. There is a transversal trough 1221 located in the second supporting area 122. The transversal trough 1221 is deeper than the grooves 1211.

The mating portion 14 includes a first wall 141 and a second wall 142 extending along the transversal direction and spaced apart from each other along the longitudinal direction, with a mating port 140 formed therebetween. The first wall 141 defines a number of contact slots 1411 thereon arranged in a row along the transversal direction, and the second wall 142 also defines a number of contact slots 1421 arranged in a row along the transversal direction. The first contact slots 1411 and the second contact slots 1421 offset from each other along the longitudinal direction.

The contacts 20 are divided into a set of first contacts 21 and a set of second contacts 22. Each first contact 21 has a mating portion 211 located in a vertical direction, a tail portion 213 located in a horizontal direction and an oblique retention portion 212 connecting with the mating portion 211 and the tail portion 213. In addition, there is a hook part 2111 formed at a front end of the mating portion 211. Each second contact 22 has a mating portion 221 located in a vertical direction, a tail portion 223 located in a horizontal direction and an curved retention portion 222 connecting with the mating portion 211 and the tail portion 213. In addition, there is a hook part 2211 formed at a front end of the mating portion 221. The mating portions 211 of the first contacts 21 and the mating portions 221 of the second contacts 22 are located in the vertical direction and spaced apart from each other along the longitudinal direction, while the tail portions 213, 223 of the first contacts 21 and the second contacts 22 are disposed in one row and spaced apart each other along the transversal direction.

The contacts 20 are mounted to the housing 10 by insert molding process, with the mating portions 211, 221 are respectively located in the contact slots 1411, 1421, the tail portions 213, 223 accommodated in the corresponding grooves 1211, and the retention portions 212, 222 combined with the base portion 12.

The cables 30 are micro coaxial cables, and each cable 30 includes an inner conductor 301, an inner insulative layer 303 enclosing the inner conductor 301, an outer conductor 302 shrouding the inner insulative layer 303 and a insulative jacket 304 shielding the outer conductor 302.

The grounding bar 40 is made of metallic material and has a rectangular shaped body portion 41 extending along the transversal direction, i.e. X direction of a coordinate system and two protrusions 42 formed at lateral sides of the body portion 41. In addition, there is a plurality of passages 43 defined in the body portion 41 and spaced apart from each other along the transversal direction. Each passage 43 extends along the longitudinal direction, i.e. Y direction of the coordinate system. The body portion 41 has a first dimension along the longitudinal direction, also a second dimension along the vertical direction, i.e. Z direction of the coordinate system. The first dimension is larger than the second dimension. Therefore, the body portion 41 not only has a lower profile, but also has robust property to meet applications such as pull or bending requirements. Further, the grounding bar 40 can be easily fabricated by machining process or stamping process. The grounding bar 40 is accommodated in the transversal trough 1221 of the base portion 12 and substantially flush with and even lower than an upper surface 1201 of the base portion 12. In addition, the grounding bar 40 is substantially aligning with a back surface 1202 of the base portion 12 and even located in front of the back surface 1202.

The cables 30 are assembled to the base portion 12, with the inner conductors 301 respectively mounted into the grooves 1211 and placed on the tail portions 213, 223, and the outer conductors 302 accommodated in the passages 43 of the grounding bar 40. Then solder balls/materials are applied to the first cavities 1212 and the second cavities 1213 to solder the inner conductors 301 and the tail portions 213, 223 together.

Figure 6:
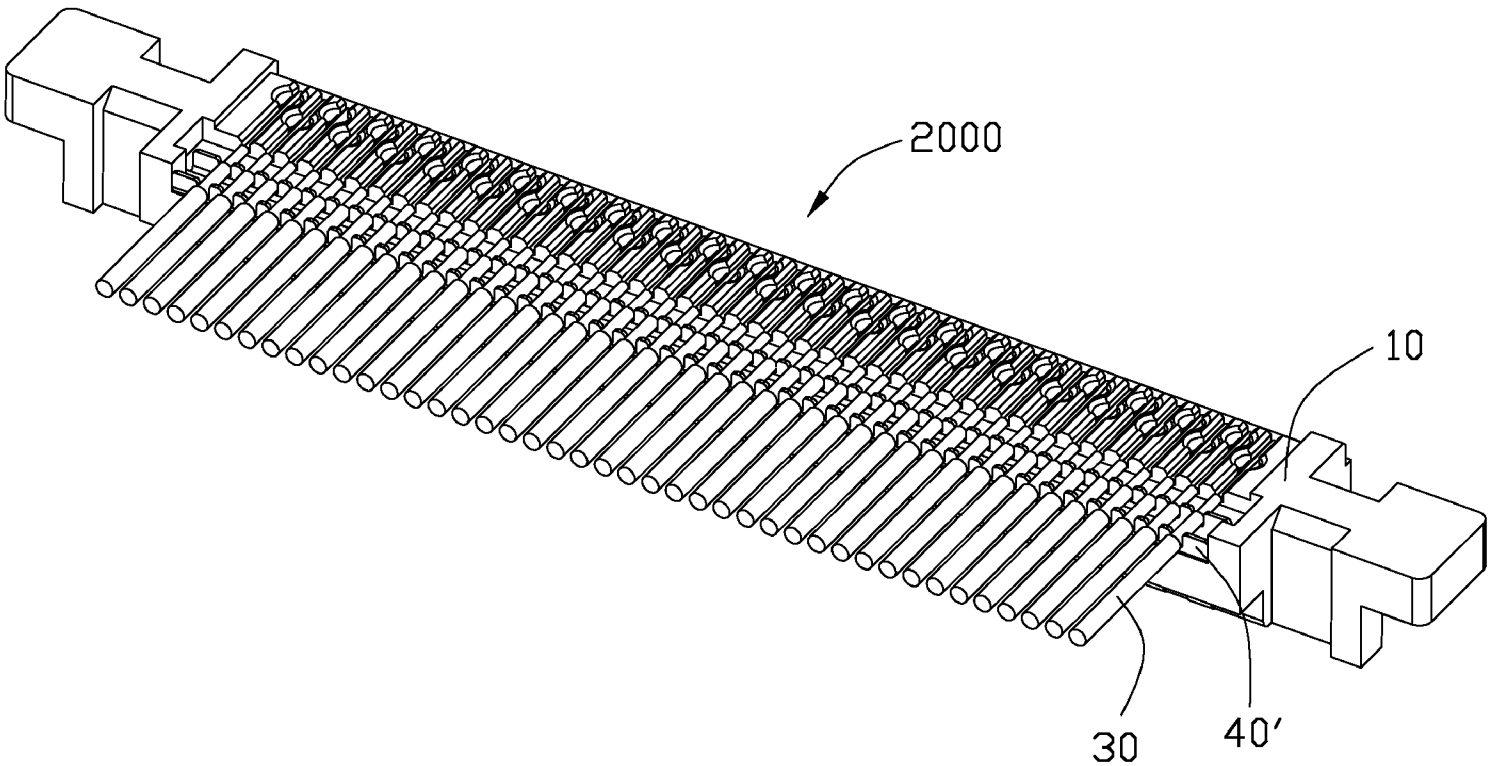
FIG. 6 is a perspective view of a cable assembly of a second embodiment in according with the present invention.
Figure 7:
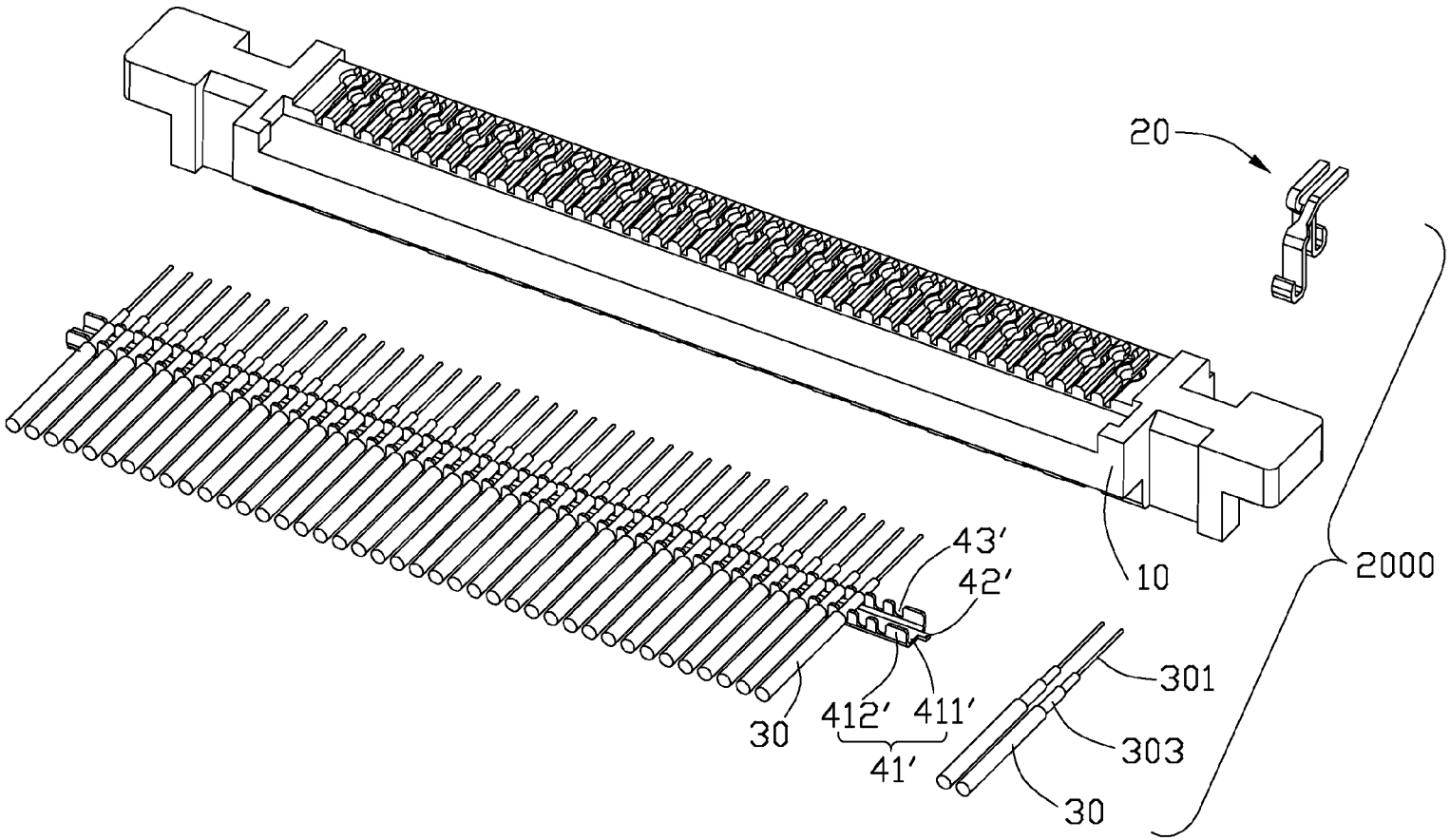
FIG. 7 is a partially exploded, perspective view of the cable assembly in FIG. 6.

Referring to FIGS. 6 to 7, a cable assembly 2000 of a second embodiment in accordance with the present invention is illustrated. The cable assembly 2000 comprises a housing 10, a plurality of contacts 20 received in the housing 10, a plurality of cables 30, a grounding bar 40' received in the housing 10. The cable assembly 2000 is similar to the cable assembly 1000, excepted for the grounding bar 40' different from the grounding bar 40, and detailed description of the same elements and their relations of the cable assembly 2000 are omitted hereby.

The grounding bar 40' is made of metallic sheet and has a substantially U-shaped body portion 41' extending along the horizontal direction, and two protrusions 42' formed at lateral sides of the body portion 41'. The body portion 41' has a horizontal side 411' and two vertical sides 412' projecting upwardly from a front and back edges of the horizontal side 411'. The two vertical sides 412' are spaced apart from each other along the longitudinal direction. In addition, there is a plurality of passages 43' respectively defined in the two vertical sides 412' and aligned with each other along the longitudinal direction. The horizontal side 411' has a first dimension along the longitudinal direction, and the vertical side 412' has second dimension along the vertical direction. The first dimension is larger than the second dimension. Therefore, the body portion 41 not only has a lower profile, but also has robust property to meet applications such as pull or bending requirements. Further, the grounding bar 40' can be easily fabricated by machining process or stamping process. The outer conductor 303 of each cable 30 is respectively accommodated in the two passages 43' along the longitudinal direction. The grounding bar 40' is combined with the insulative housing 10.

Figure 8:
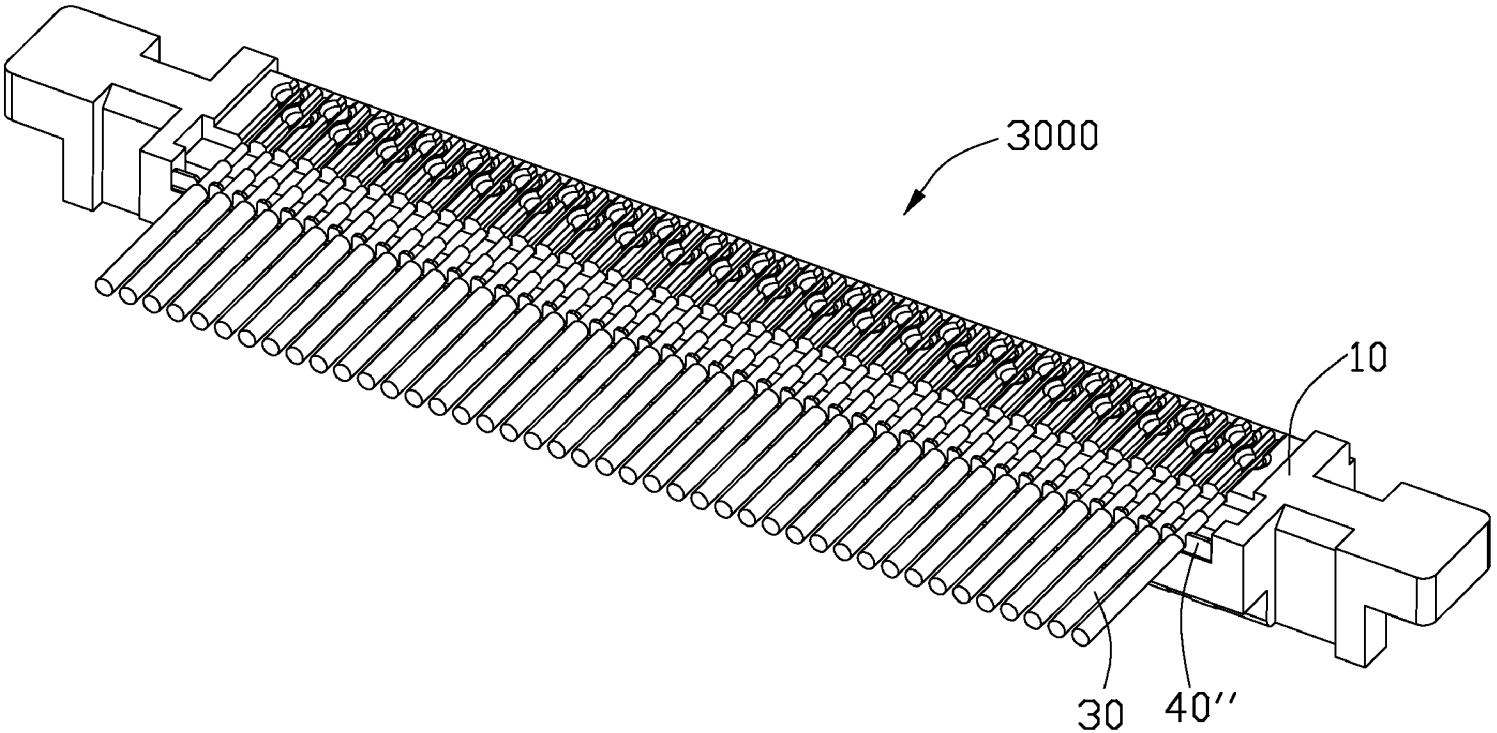
FIG. 8 is a perspective view of a cable assembly of a third embodiment in according with the present invention.
Figure 9:
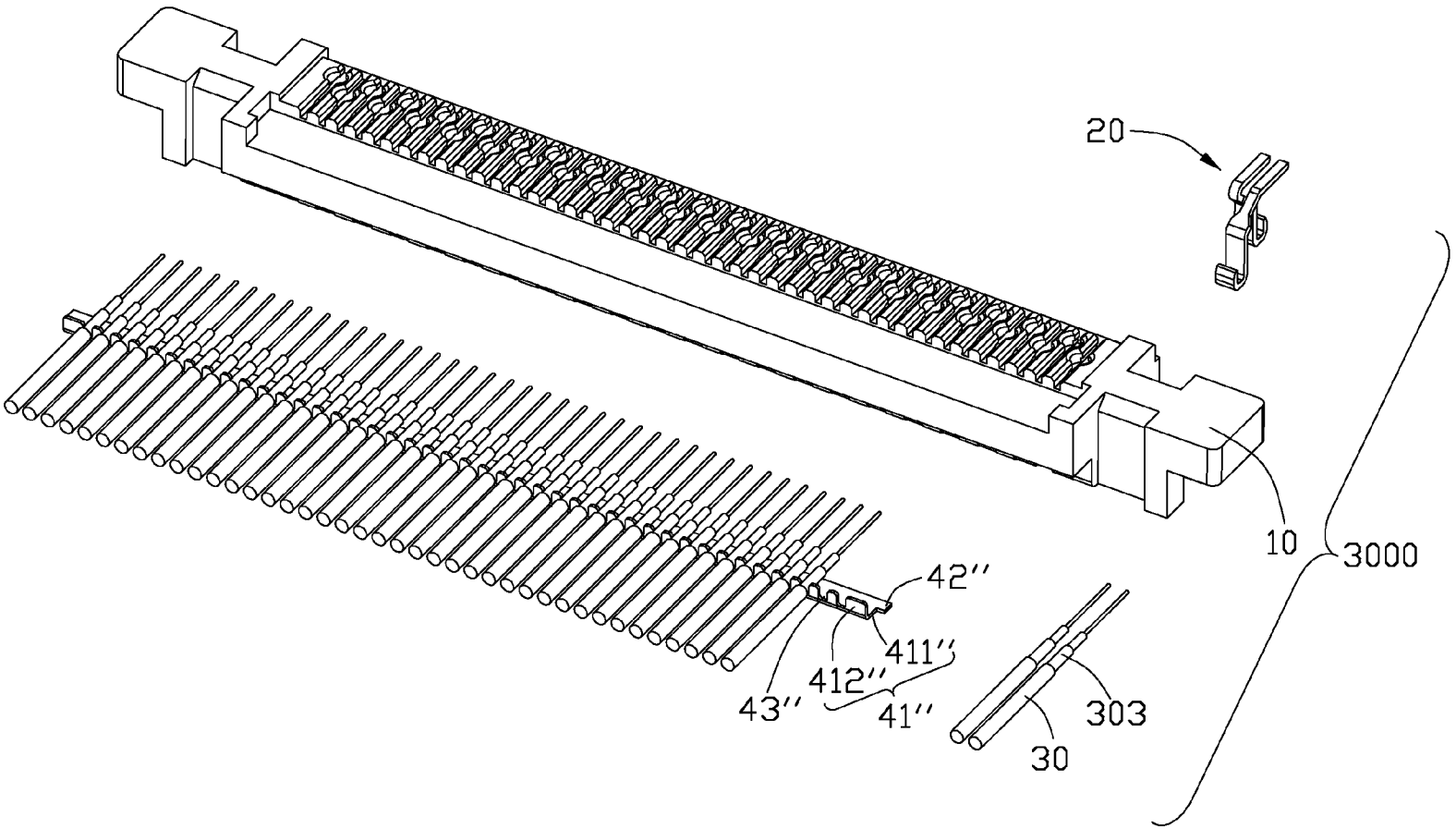
FIG. 9 is a partially exploded, perspective view of the cable assembly in FIG. 8.

Referring to FIGS. 8 to 9, a cable assembly 3000 of a third embodiment in accordance with the present invention is illustrated. The cable assembly 3000 comprises a housing 10, a plurality of contacts 20 received in the housing 10, a plurality of cables 30, a grounding bar 40" received in the housing 10. The cable assembly 3000 is similar to the cable assembly 1000, excepted for the grounding bar 40" different from the grounding bar 40, and detailed description of the same elements and their relations of the cable assembly 3000 are omitted hereby.

The grounding bar 40" is made of metallic sheet and has a substantially L-shaped body portion 41" extending along the horizontal direction, and two protrusions 42" formed at lateral sides of the body portion 41". The body portion 41" has a horizontal side 411" and a vertical sides 412" projecting upwardly from a back edge of the horizontal side 411". In addition, there is a plurality of passages 43" respectively defined in the vertical sides 412" and aligned with each other along the longitudinal direction. The horizontal side 411" has a first dimension along the longitudinal direction, and the vertical side has second dimension along the vertical direction. The first dimension is larger than the second dimension. Therefore, the body portion 41" not only has a lower profile, but also has robust property to meet applications such as pull or bending requirements. Further, the grounding bar 40" can be easily fabricated by machining process or stamping process. The outer conductor 303 of each cable 30 is accommodated in the two passages 43" along the longitudinal direction. The grounding bar 40" is combined with the insulative housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

an elongated housing having a base portion and a mating portion, said base portion having an upper surface;

a plurality of contacts received in the housing;

a plurality of cables each comprising an inner conductor and an outer conductor insulated from the inner conductor, said inner conductor connected to the corresponding contact;

a grounding bar mounted to the base portion and substantially flush with the upper surface, said grounding bar extending along a transversal direction, with a plurality of passages defined thereon to accommodate the outer conductors, respectively.

2. The cable assembly as claimed in claim 1, wherein the grounding bar has a first dimension along a longitudinal direction and a second dimension along a vertical direction, and the first dimension is larger than the second dimension.

3. The cable assembly as claimed in claim 1, wherein the grounding bar has a rectangular shaped body portion with the passages defined thereon and spaced apart from each other along the transversal direction.

4. The cable assembly as claimed in claim 3, wherein each of the passages extends along the longitudinal direction.

5. The cable assembly as claimed in claim 1, wherein the grounding bar has a substantially U-shaped body portion including a horizontal side and two vertical sides projecting upwardly from a front and back edges of the horizontal side, and the passages are defined on the two vertical sides.

6. The cable assembly as claimed in claim 5, wherein the two vertical sides are spaced apart from each other along the longitudinal direction and respectively extend along the transversal direction.

7. The cable assembly as claimed in claim 6, wherein the passages of the two vertical sides align with each other along a longitudinal direction.

8. The cable assembly as claimed in claim 5, wherein the horizontal side has a first dimension along the longitudinal direction, and the vertical side has second dimension along the vertical direction, and the first dimension is larger than the second dimension.

9. The cable assembly as claimed in claim 1, wherein the grounding bar has a substantially L-shaped body portion including a horizontal side and a vertical side projecting upwardly from a back edge of the horizontal side, and the passages are defined on the vertical side.

10. The cable assembly as claimed in claim 9, wherein the horizontal side has a first dimension along the longitudinal direction, and the vertical side has second dimension along the vertical direction, and the first dimension is larger than the second dimension.

11. A cable assembly, comprising:

an elongated housing having a base portion and a mating portion, said base portion having a top side defining a plurality of grooves and a trough located behind the plurality of grooves;

a plurality of contacts received in the housing, each contact having a mating portion extending into the mating portion and a tail portion accommodated in the corresponding groove;

a grounding bar having passages, the grounding bar is mounted into the trough of the base portion; and a plurality of cables each comprising an inner conductor and an outer conductor insulated from the inner conductor, said inner conductor received in the corresponding groove and supported by the tail portion of the corresponding contact, and each outer conductor received in a corresponding one of the passages of the grounding bar.

12. The cable assembly as claimed in claim 11, wherein the grounding bar extends along a transversal direction and has a first dimension along a longitudinal direction and a second dimension along a vertical direction, and the first dimension is larger than the second dimension.

13. The cable assembly as claimed in claim 11, wherein the plurality of contacts are divided into a set of first contacts and a set of second contacts, and the first contacts and the second contacts both have mating portions spaced apart from each other along a longitudinal direction and tail portions arranged in a row along a transversal direction perpendicular to the longitudinal direction.

14. The cable assembly as claimed in claim 13, wherein the first contacts have oblique retention portions connecting with the mating portions and the tail portions, and the retention portions are combined with the base portion of the insulative housing.

15. The cable assembly as claimed in claim 13, wherein the second contacts have curved retention portions connecting with the mating portions and the tail portions, and the retention portions are combined with the base portion of the insulative housing.

16. The cable assembly as claimed in claim 13, wherein the mating portions of the first contacts and the mating portions of the second contacts offset from each other along the longitudinal direction.

17. A cable connector assembly comprising:

an insulative housing defining an elongated mating port in a lengthwise direction;

a plurality of contacts disposed in the housing with contacting sections located upon two opposite sides of the mating port in two rows each along said lengthwise direction and spaced from each other in a transverse direction perpendicular to said lengthwise direction, and tail sections extending out of the housing;

a grounding bar extending along said lengthwise direction, associated with the housing and essentially beside the tail sections of the contacts, and further defining therein a plurality of passages each extending in said transverse direction;

a plurality of wires each including an inner conductor and outer conductor coaxially; wherein the inner conductor is soldered to the corresponding tail sections, respectively, and the outer conductor is securely received in the corresponding passages, respectively.

18. The cable connector as claimed in claim 17, wherein the tail sections are arranged in one row along said lengthwise direction.

19. The cable connector as claimed in claim 18, wherein said grounding bar is located beside the tail sections in said transverse direction.

20. The cable connector as claimed in claim 17, wherein the outer conductors are snugly received in the corresponding passages with an interference fit.

* * * * *